US005199923A

United States Patent [19]

Müller

[11] Patent Number: 5,199,923

[45] Date of Patent: Apr. 6, 1993

[54] CARBON COPY SET CONSISTING OF UNINSCRIBED AND/OR INSCRIBED SHEETS AND/OR FORMS

[76] Inventor: Thomas Müller, Bendstrasse 17, 5100 Aachen, Fed. Rep. of Germany

[21] Appl. No.: 700,135

[22] PCT Filed: Nov. 18, 1989

[86] PCT No.: PCT/DE89/00723

§ 371 Date: May 24, 1991

§ 102(e) Date: May 24, 1991

[87] PCT Pub. No.: WO90/05639

PCT Pub. Date: May 31, 1990

[30] Foreign Application Priority Data

Nov. 21, 1988 [DE] Fed. Rep. of Germany ..... 3839240
Mar. 18, 1989 [DE] Fed. Rep. of Germany ..... 3908925

[51] Int. Cl.[5] ..... B42D 1/06; B42D 1/10; B41L 1/22

[52] U.S. Cl. ..... 462/18; 281/21.1; 462/17; 462/20; 462/56

[58] Field of Search ..... 281/21.1; 462/8, 17, 462/18, 19, 20, 53, 54, 55, 56, 57

[56] References Cited

U.S. PATENT DOCUMENTS 2,546,584 3/1951 Brock, Jr. ..... 462/18
3,778,324 12/1973 La vigne ..... 281/21.1
4,248,919 2/1981 Davis ..... 462/17 X
4,798,401 1/1989 Greig ..... 462/20

FOREIGN PATENT DOCUMENTS 7971 12/1987 World Int. Prop. O. ..... 462/56

*Primary Examiner*—Paul A. Bell
*Attorney, Agent, or Firm*—Staas & Halsey

[57] ABSTRACT

A carbon copy set includes a sheet having an elongated edge. An elongated strip of material having an adhesive coating thereon extending longitudinally of the strip on one side thereof is attached to the sheet at its elongated edge by a first portion of the adhesive coating. The strip is disposed such that an elongated edge of the strip and a second portion of the adhesive coating are positioned beyond the elongated edge of the sheet. The sheet and the elongated strip together present a combined sheet having the second portion of the adhesive coating exposed on one side thereof between the elongated edge of the first sheet and the elongated edge of the strip. The set may also include another sheet having an elongated edge. The combined sheet overlies the last mentioned sheet and is attached thereto by the second portion of the adhesive coating such that the elongated edge of the second sheet and the elongated edge of the strip of the combined sheet coincide.

7 Claims, 2 Drawing Sheets

CARBON COPY SET CONSISTING OF UNINSCRIBED AND/OR INSCRIBED SHEETS AND/OR FORMS

Figure 1:
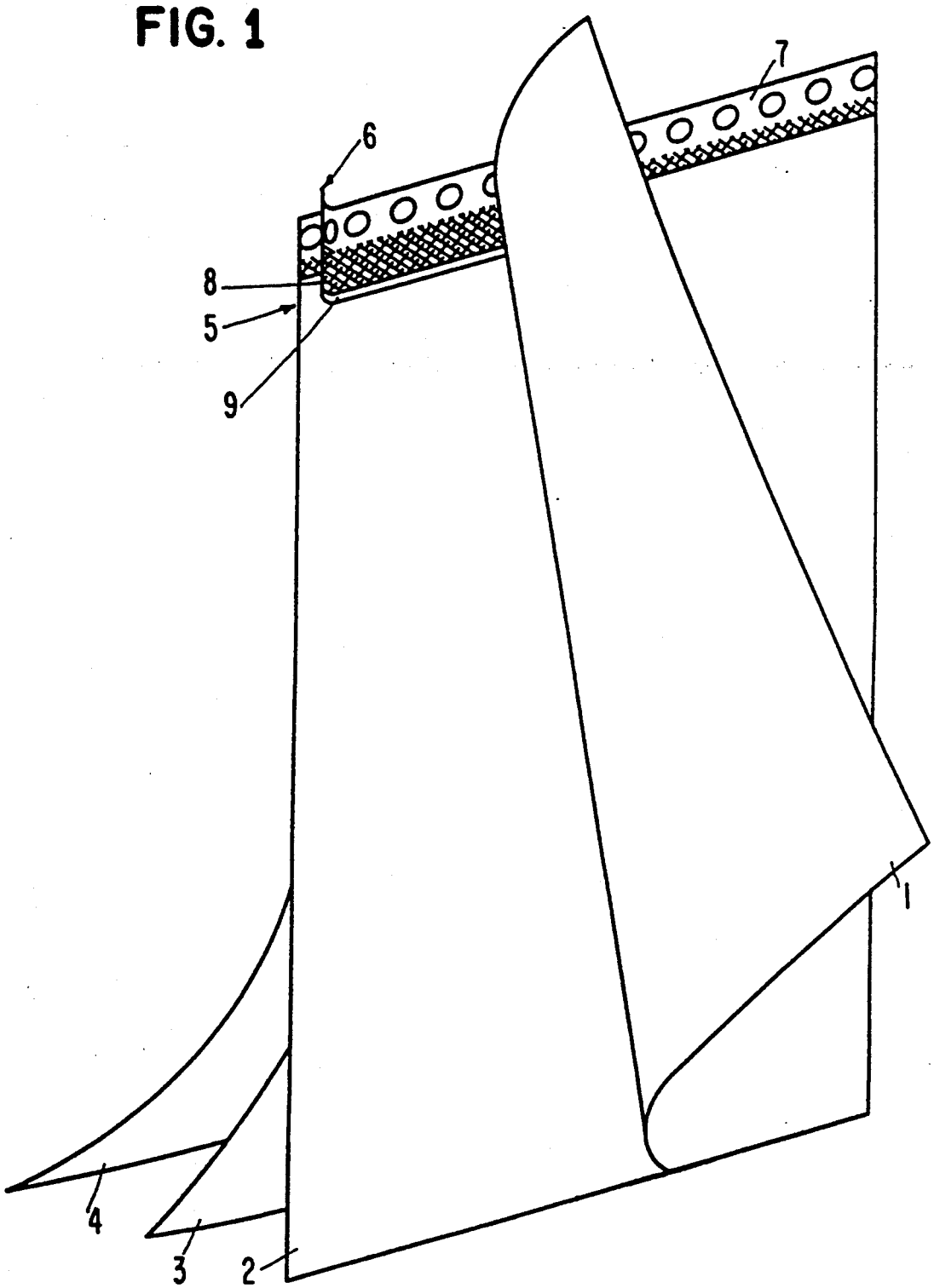

The invention relates to a carbon copy set consisting of uninscribed and/or inscribed sheets connected along at least one edge.

Such carbon copy sets can be used for inscribing by hand or by typewriter. They can also be used with printers, recorders or the like, especially with printers operating in conjunction with computers. Each carbon copy set can be drawn in individually or be secured to a carrier element which passes the carbon copy sets one after the other to the printer or the like.

A carbon copy set is already known (DE-GM 1 938 645) in which the individual sheets to be inscribed have a separating strip formed by a perforated line. The sheets are connected with each other by means of this separating strip. Carbon copy sheets are placed loosely between these sheets. Each sheet has a separating strip which is bonded to the other sheets by means of an adhesive. Disturbing edge marks always remain along the separating line. The same applies by analogy for the carbon copy set forth from DE-AS 1 611 5387.

The task of the present invention consists in creating a carbon copy set of which the individual sheets can easily be joined together.

This task is solved in accordance with the invention by a carbon copy set of the kind described at the beginning in that in order to join two or more sheets, a strip of material is arranged along one edge of each sheet which has one or more adhesive-coated regions on one side only and forms the connection between two or more sheets, whereby in each case one region with a width $\Delta X1$ serves to attach the strip of material to a sheet and a second region with a width $\Delta X2$ serves as the adhesive bond to the strip of material of another sheet, to another sheet or to another carbon copy set.

In this way carbon copy sets with the desired number of copies can be combined, whereby the individual sheets of the set can be of differing size, format or be differently printed.

The coating of the strip of material on one side only has, above all, advantages in that the production of such strips of material has been known for a long time and is a low-cost operation and that the handling of such strips of material is simple, especially in the production of carbon copy sets.

In order to form a carbon copy set with two sheets, it is fundamentally sufficient to arrange a strip of material in the manner described above at one edge only, in particular at the head end, and to join the sheets formed in this way together. However, it may also be expedient to arrange a strip of material alone or additionally, e.g., at the left-hand side edge, which makes it possible to leaf through the sheets joined together to form a carbon copy set. Such a strip or strips of material can fundamentally be provided on each side edge of the carbon copy set.

The carbon copy set in accordance with the invention can further be designed in such a way that the strip of material has an adhesive coating of an adhesive which can be separated without leaving any residue. With such an adhesive coating the adhesive bonds can be dissolved and joined together optionally at any time. In this way, each sheet can be separated individually from the combined sheets. After this the strip of material can then either be removed from the sheet or be left to reinforce the edge. Adhesives with the properties required here are available in the trade and known, e.g., in connection with removable self-stick notes.

The carbon copy set in accordance with the invention can be designed in such a way that the strip of material is subdivided into two separable areas by a longitudinal perforation. In this way, it is possible to separate the bonded sheets of the carbon copy set from one another with just a single action by detaching them at the perforation of the strip of material. Furthermore, the part of the strip of material still bonded to the sheet can serve as reinforcement for punching holes in and filing the sheet, in particular when the strip of material is arranged along the left-hand side.

The carbon copy set in accordance with the invention can further be designed in such a way that the strip of material is arranged on the front side of the sheet. If the adhesive-coated regions are selected in such a way that the strip of material remains on the carbon copy set when a sheet is separated, it is possible to stick the separated sheet with the inscribed front side on a wall, door or the like as a notice or information sheet.

The carbon copy set in accordance with the invention can further be designed in such a way that the strip of material of the last sheet of a carbon copy set has no adhesive coating in the region $\Delta X2$. In this way, carbon copy sets can be stored on top of one another without sticking together. Furthermore, sets formed in this way are also suitable for building up continuous form paper with continuous carrier strips.

The carbon copy set in accordance with the invention can further be designed in such a way that the carbon copy sets are arranged offset alternatingly over one another by a length $\Delta L$ on their adhesive edge. Carbon copy sets built up in this way automatically form a block with gaps on at least two sides which facilitate selective grasping and loosening of a carbon copy set.

The carbon copy set in accordance with the invention can further be designed in such a way that the last sheet of the carbon copy set has no strip of material and that this sheet is arranged in such a way at the carbon copy set that it covers the whole adhesive region of the strip of material of the adjacent carbon copy set. This makes it possible to store the carbon copy sets on top of one another without them sticking together.

The carbon copy set in accordance with the invention can further be designed in such a way that the format of the last sheet of the carbon copy set is longer or wider than the other sheets of the carbon copy set by the precise dimension $\Delta X3$. This makes the surface area of the final sheet available for inscription just as large as that of the other sheets of the carbon copy set.

The carbon copy set in accordance with the invention can further be designed in such a way that a row of holes is arranged in the strip of material or in the head region of the last sheet of the carbon copy set if this has no strip of material. This row of holes serves to guide and position the strip of material or the carbon copy set.

The carbon copy set in accordance with the invention can further be designed in such a way that a perforated line is arranged along the middle of the row of holes at the strip of material or at the last sheet of the carbon copy set if this has no strip of material, that the holes lie just completely within the region $\Delta X3$ and that the strip of material is not provided with any adhesive coating in the region of the row of holes. When a carbon copy set designed in this way is detached by tearing along the perforation, it is easily possible to to grasp the remaining residues of the strip of material projecting over the edges of the separate sheets of the carbon copy set and to remove these from the sheet. Furthermore, a strip of material which is not provided with adhesive coating along its whole width is easier to guide and to position in the production of carbon copy sets.

Finally, the carbon copy set in accordance with the invention, can be designed in such a way that the strip of material has an adhesive-free region for grasping the strip of material. In this way, the separation of the carbon copy set into its individual sheets and the detachment of the strip of material are simplified.

In the following part of the specification a few practical embodiments of the carbon copy set in accordance with the invention are described with the aid of drawings.

Figure 3:
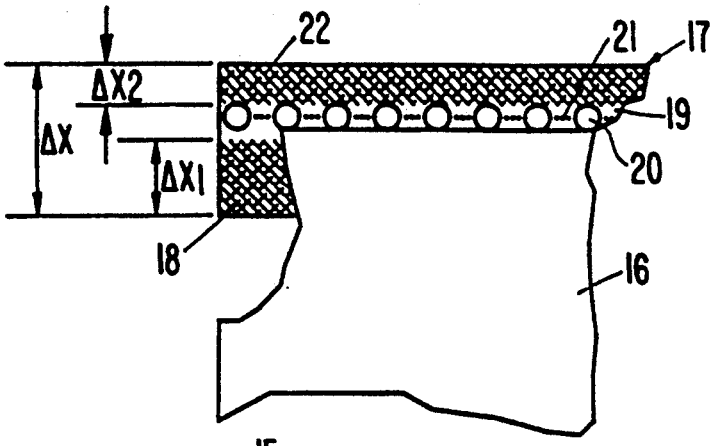
Figure 2:
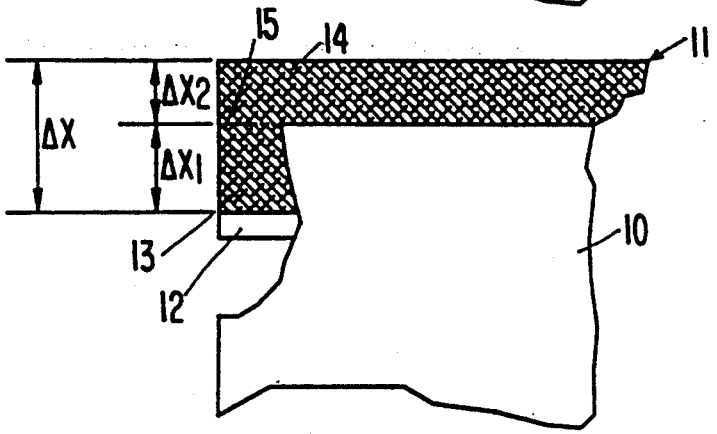
Figure 4:
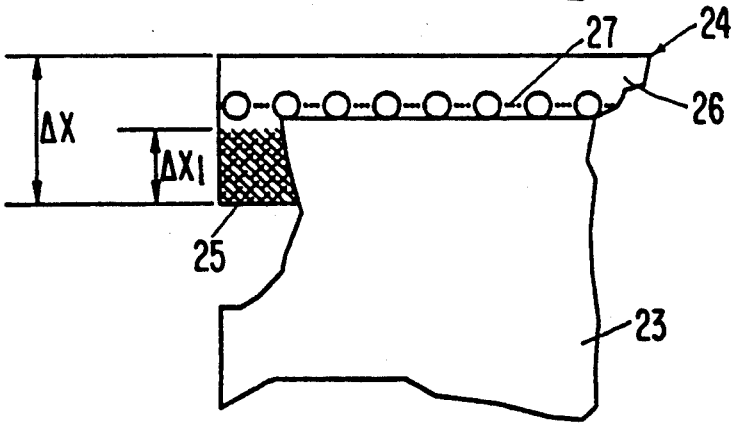
Figure 5:
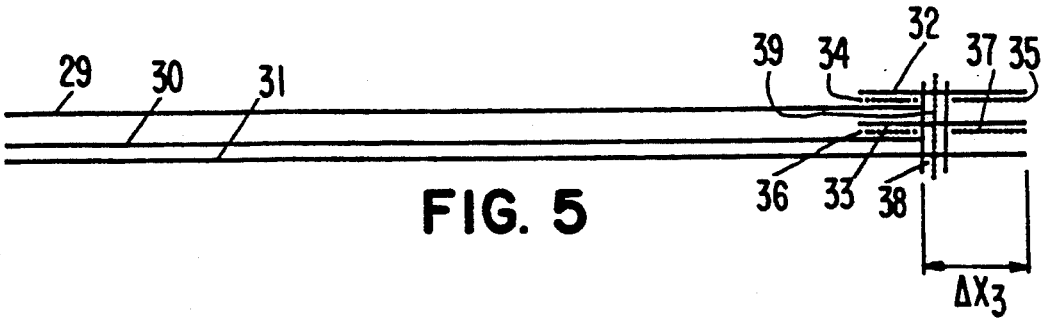

FIG. 1 shows a perspective view of a carbon copy set in accordance with the invention comprising four sheets, FIG. 2 shows a partial view of a top view of one side of a carbon copy set with a strip of material which has two adhesive-coated regions separated from one another by a perforation, FIG. 3 shows a partial view of a top view of one side of a carbon copy set with a strip of material which has two adhesive-coated regions and a region free of adhesive between them, FIG. 4 shows a partial view of a top view of one side of a carbon copy set with a strip of material which has only one adhesive-coated region, and FIG. 5 shows a diagrammatic presentation of a carbon copy set with three sheets, which are connected detachably at their head end with two strips of material with an adhesive coating on one side only.

The carbon copy set illustrated in FIG. 1 in accordance with a practical embodiment of the invention has four sheets 1, 2, 3, 4. At its head 5, the sheets 1, 2, 3, 4 are joined together by four strips of material 6, each of which are provided with an adhesive coating on one side, which makes it possible to hold the sheets 1, 2, 3, 4 sufficiently safely on the strip of material 6, but which, at the same time, allows the sheets 1, 2, 3, 4 to be detached from the strip of material 6 free of residue and tearing. Accordingly, such a strip of material 6 is located between every two sheets 1, 2, 3, 4 arranged on top of one another.

The strip of material 6 illustrated in FIG. 1 has an outer edge 7 with holes which is free of adhesive and which projects beyond the sheets 1, 2, 3, 4. Adjacent to this is an area 8 coated with adhesive of which one region serves to attach the strip of material 6 to one sheet 1, 2, 3, 4 and another region projecting beyond the upper edge of this sheet 1, 2, 3, 4 serves to attach a strip of material 6 of another sheet. Finally, the area 8 is followed by an inner edge 9 free of adhesive. This inner edge 9 can easily be grasped in order to detach the strip of material 6 from a sheet 1, 2, 3, 4. The outer edge 7 can also be used for the same purpose.

The sheets 1, 2, 3, 4 are joined together in such a way, in accordance with FIG. 1, that sheet 1 is attached by detachable adhesive bonding to a region of the area 8 of a strip of material arranged on the back of the sheet. Combinations of sheet and strip of material made up in the same way are formed with sheets 2, 3, 4. These combinations can be arranged on top of one another and be bonded together with detachable adhesive in the regions of area 8 projecting beyond the sheets.

If the outer edge 7 alone is used for the compilation of the carbon copy sets, it may be expedient to detach this outer edge 7 subsequently, so that the strip of material 6 does not protrude outwards beyond the format of the sheets 1, 2, 3, 4.

FIG. 2 shows a sheet 10 on which a strip of material 11 is arranged. The region 12 at the lower edge of the strip of material 11 is free of adhesive. It serves for easy grasping and detaching of the strip of material 11. Regions 13 and 14 are provided with an adhesive coating. Region 13 serves to secure the strip of material 11 to the sheet 10. Region 14 serves to secure the combination of sheet 10 and the strip of material 11 to a combination produced and in the same way or a similar way. This region 14 can also be used to attach the combination to objects or surfaces, like the known self-stick notes.

Sheet 10 is drawn from the reverse side in this presentation, so that when the combination is stuck to a door or the like, the front side of sheet 10 can be seen.

Regions 13 and 14 are separated from one another by a perforated line 15. In the case of a carbon copy set which is built up with strips of material 11 formed in this way, all the sheets can be separated from each other in a single action by tearing along the perforation 15. The strips of material remaining on the sheets can either serve as reinforcement for punching holes in the sheet and filing it, or they can be removed completely.

FIG. 3 shows a sheet 16 on which a strip of material 17 is arranged. The strip of material 17 has a region 18 coated with adhesive to which the sheet 16 is secured. This is followed by an adhesive-free region 19. A row of holes 20 is arranged in this region 19 which has a perforated line 21 in the middle. The adhesive-free region 19 and the row of holes 20 serve for better handling of the strip of material 17 and the carbon copy set during mechanical production of the combination (sheet; strip of material) and of the carbon copy set. Finally, the strip of material 17 also has a region 22 coated with adhesive, the function of which is identical to that of region 14 protruding beyond the sheet in FIG. 2. Here, too, the reverse of sheet 16 is illustrated.

FIG. 4 shows a sheet 23 on which a strip of material 24 is arranged. The strip of material 24 is to be seen by way of analogy with the strip of material 17 in FIG. 3. The combination in accordance with FIG. 4 can be placed on top of a combination in accordance with FIG. 3 in order to form the bottom sheet of a carbon copy set which then has no uncovered adhesive-coated region. The following applies: adhesive-coated region 25 corresponds to 18 in FIG. 3; adhesive-free region with row of holes 26 corresponds to 22 in FIG. 3 and the perforated line 27 arranged in the middle of the row of holes corresponds to 21 in FIG. 3.

FIG. 5 shows a carbon copy set with the sheets 29, 30, 31 which is joined together by means of two strips of material 32, 33 in diagrammatic form. The strip of material 32 is connected with the sheet 29 via an adhesive-coated region 34. It has a second adhesive-coated region 35 which produces a connection with the strip of material 33 arranged beneath it, which, in turn, is connected with the sheet 30 via an adhesive-coated region 36. The sheet 31 intended as bottom sheet protrudes by the dimension $\Delta X3$ beyond the other sheets 29, 30 at the head of the copy set. In this area, it is bonded with an adhesive-coated region 37 of the strip of material 33. Carbon copy sets formed in this way can be stored anywhere without sticking together. Furthermore, sheet 31 and the strips of material 32, 33 have a row of holes 38 and a perforation line 39 for fast separation of the carbon copy sets.

I claim:

1. A carbon copy set comprising:

a first sheet having an elongated edge;

a first elongated strip of material having an adhesive coating thereon extending longitudinally of the strip on one side thereof, said elongated strip being attached to said first sheet at its elongated edge by a first portion of the adhesive coating, said strip being disposed such that an elongated edge of the strip and a second portion of the adhesive coating are positioned beyond the elongated edge of said first sheet, said first sheet and said first elongated strip together presenting a first combined sheet having said second portion of the adhesive coating exposed on one side thereof between the elongated edge of the first sheet and the elongated edge of the strip; and a second sheet having an elongated edge, said combined sheet overlying said second sheet and being attached thereto by said second portion of the adhesive coating such that the elongated edge of the second sheet and the elongated edge of the strip of the first combined sheet coincide.

2. A carbon copy set as set forth in claim 1, wherein said second sheet comprises a second combined sheet, said second combined sheet including a third sheet having an elongated edge and a second elongated strip having a said adhesive coating on one side thereof, said second portion of adhesive coating on said first strip adhering to the other side of the second strip.

3. A carbon copy set as set forth in claim 1, wherein said second sheet comprises a bottom sheet.

4. A carbon copy set as set forth in claim 1, wherein said adhesive coating comprises an adhesive material which can be separated from the second sheet without leaving any residue.

5. A carbon copy set as set forth in claim 1, wherein said first elongated strip has a line of perforations therein extending along the strip between said portions of adhesive.

6. A carbon copy set as set forth in claim 1, wherein said first sheet has inscriptions on one side thereof and said first strip is attached to said one side of the first sheet.

7. A carbon copy set as set forth in claim 1, wherein said first strip of material has an adhesive-free zone to facilitate grasping of the same.

* * * * *